US012089701B2

(12) United States Patent
Peng

(10) Patent No.: US 12,089,701 B2
(45) Date of Patent: Sep. 17, 2024

(54) WATERPROOF AIRTIGHT ZIPPER WITH DOUBLE ZIPPER SLIDERS

(71) Applicants: Foshan Xinyabo Technology Co., Ltd., Foshan (CN); Jianjun Peng, Loudi (CN)

(72) Inventor: Jianjun Peng, Loudi (CN)

(73) Assignees: Jianjun Peng, Loudi (CN); Foshan Xinyabo Technology Co., Ltd., Foshan (CN)

( * ) Notice: Subject to any disclaimer, the term of this patent is extended or adjusted under 35 U.S.C. 154(b) by 0 days.

(21) Appl. No.: 18/315,034

(22) Filed: May 10, 2023

(65) Prior Publication Data

US 2023/0276906 A1 Sep. 7, 2023

(30) Foreign Application Priority Data

Sep. 8, 2022 (CN) ..... 202222390348.9

(51) Int. Cl.
*A44B 19/32* (2006.01)
*A44B 19/26* (2006.01)

(52) U.S. Cl.
CPC ..... *A44B 19/32* (2013.01); *A44B 19/26* (2013.01)

(58) Field of Classification Search
CPC ..... A44B 19/32; A44B 19/26
See application file for complete search history.

(56) References Cited

U.S. PATENT DOCUMENTS 3,892,016 A * 7/1975 Brown ..... A44B 19/32 24/389
4,485,534 A * 12/1984 Pilie ..... A41D 13/00 24/384
5,231,736 A * 8/1993 Hohenocker ..... A44B 19/36 24/387
6,308,541 B1 * 10/2001 Stowe ..... A45C 13/18 70/68
8,650,724 B2 * 2/2014 King ..... A45C 13/103 4/386

(Continued)

FOREIGN PATENT DOCUMENTS

CN 212545911 U 2/2021
CN 214386373 U 10/2021
CN 216247060 U 4/2022

*Primary Examiner* — Robert Sandy
*Assistant Examiner* — Louis A Mercado
(74) *Attorney, Agent, or Firm* — Jeenam Park

(57) ABSTRACT

Provided is a waterproof airtight zipper with double zipper sliders, including an upper waterproof zipper part and a lower waterproof zipper part; a lower edge of the first top stopper and an upper edge of the second top stopper are fixedly connected as an integral intermediate sealing structure; the intermediate sealing structure is located between both the zipper sliders of the upper waterproof zipper part and the lower waterproof zipper part and is arranged in a disconnected manner; and an opening is formed at the intermediate sealing structure. A form of double zipper sliders is adopted to make left and right ends stressed at the same time, so that it is more labor-saving to pull open the zipper; the way of pulling open the zipper bidirectionally facilitates operation and use; and the intermediate sealing structure can ensure the air tightness effect of the waterproof sealing zipper.

4 Claims, 4 Drawing Sheets

(56) References Cited

U.S. PATENT DOCUMENTS

| | | | | |
|---|---|---|---|---|
| 8,819,901 | B2 * | 9/2014 | Muratsubaki | A41F 1/008 24/418 |
| 9,888,747 | B2 * | 2/2018 | Smith | A44B 19/30 |
| 9,902,529 | B2 * | 2/2018 | Reinders | A44B 19/305 |
| 10,492,572 | B1 * | 12/2019 | Omote | A44B 19/26 |
| 11,033,081 | B2 * | 6/2021 | Myerscough | A44B 19/32 |
| 2008/0196217 | A1 * | 8/2008 | Eschbach | A44B 19/262 24/386 |
| 2010/0154178 | A9 * | 6/2010 | Ortlieb | A44B 19/26 24/385 |
| 2013/0074293 | A1 * | 3/2013 | Mikuma | A44B 19/42 24/430 |

* cited by examiner

WATERPROOF AIRTIGHT ZIPPER WITH DOUBLE ZIPPER SLIDERS

CROSS-REFERENCE TO RELATED APPLICATIONS

The application claims priority to Chinese patent application No. 202222390348.9, filed on Sep. 8, 2022, the entire contents of which are incorporated herein by reference.

TECHNICAL FIELD

The present invention relates to the field of zippers, in particular to a waterproof airtight zipper with double zipper sliders.

BACKGROUND

Zippers are connectors that rely on zipper teeth or tracks in continuous arrangement to merge or separate items, and are now widely used in clothing, bags, tents, etc. In order to meet the waterproof and airtight function of some products, some zippers are also designed to be waterproof and airtight.

At present, luggage zippers adopt a one-way zipper, which require a larger force when pulling in a single direction, resulting in relative strenuosity and shorter service life. In the use of the one-way zipper, if a suitcase needs to be completely opened, the zipper needs to be pulled at a long distance around the suitcase, which is inconvenient in operation. In the use of a traditional zipper with double zipper sliders, a gap exists between two zippers, resulting in insufficient protection of waterproofness and air tightness.

A zipper structure with double zipper sliders featuring better waterproofness and air tightness is needed now to solve the above problems.

SUMMARY

The present invention provides a waterproof airtight zipper with double zipper sliders. By carrying out technical transformation on existing waterproof zippers, the problems of the existing one-way zippers of a larger force, inconvenience to pull open the zipper, a larger one-way pulling distance, and inconvenient operation are solved.

In order to achieve the above object, the present invention adopts the technical solution as follows:

a waterproof airtight zipper with double zipper sliders, including: an upper waterproof zipper part and a lower waterproof zipper part, where the upper waterproof zipper part includes a first bottom stopper, a first zipper tooth assembly, a first zipper slider and a first top stopper; an upper end of the first zipper tooth assembly is provided with the first bottom stopper; a lower end of the first zipper tooth assembly is provided with the first top stopper; the first slider is mounted between the first bottom stopper and the first top stopper; the lower waterproof zipper part includes a second top stopper, a second zipper tooth assembly, a second zipper slider and a second bottom stopper; an upper end of the second zipper tooth assembly is provided with the second top stopper; a lower end of the second zipper tooth assembly is provided with the second bottom stopper; the second slider is mounted between the second top stopper and the second bottom stopper; a lower edge of the first top stopper and an upper edge of the second top stopper are fixedly connected as an integral intermediate sealing structure; the intermediate sealing structure is located between both the zipper sliders of the upper waterproof zipper part and the lower waterproof zipper part and is arranged in a disconnected manner; and an opening is formed at the intermediate sealing structure when the first zipper slider and the second zipper slider move upwards and downwards respectively.

Preferably, the first zipper tooth assembly includes a first left mouth fixing tape, a first right mouth fixing tape and first mouth parts; the first mouth parts are respectively mounted at the edges of inside tapes of the first left mouth fixing tape and the first right mouth fixing tape; the first mouth parts on the left and right sides are arranged in an interlocking manner; and the first left mouth fixing tape and the first right mouth fixing tape are arranged colliding with each other;

the second zipper tooth assembly includes a second left mouth fixing tape, a second right mouth fixing tape and second mouth parts; the second mouth parts are respectively mounted on the edges of inside tapes of the second left mouth fixing tape and the second right mouth fixing tape; the second mouth parts on left and right sides are arranged in an interlocking manner; and the second left mouth fixing tape and the second right mouth fixing tape are arranged colliding with each other.

Preferably, the first left mouth fixing tape and the second left mouth fixing tape are integrally formed, and the first right mouth fixing tape and the second right mouth fixing tape are integrally formed.

Preferably, each of the first left mouth fixing tape, the first right mouth fixing tape, the second left mouth fixing tape and the second right mouth fixing tape is composed of a weaving tape layer and a TPU waterproof membrane layer; the weaving tape layer is an inner layer; and the TPU waterproof membrane layer is wrapped on upper and lower layers of the weaving tape layer.

Preferably, the intermediate sealing structure includes a first zipper slider stop block, a second zipper slider stop block and intermediate sealing ends; the intermediate sealing structure from top to bottom provides the first zipper slider stop block, the intermediate sealing ends, and the second zipper slider stop block in sequence; the first zipper slider stop block and the first zipper slider are arranged colliding with each other; the second zipper slider stop block and the second zipper slider are arranged colliding with each other; the intermediate sealing ends on the left and right sides are provided with protruding parts in a protruding manner towards the center; and the protruding parts are arranged colliding with each other when the first zipper slider and the second zipper slider are located at the intermediate sealing structure.

The present invention has the beneficial effects as follows:

in the present invention, the upper waterproof zipper part and the lower waterproof zipper part are arranged; the bottom stopper of the upper waterproof zipper part and the top stopper of the lower waterproof zipper part are fixedly connected to each other to form the integral intermediate sealing structure; the intermediate sealing structure is provided with the first zipper slider stop block, the second zipper slider stop block and intermediate sealing ends; the first zipper slider on the upper side is collided by the first zipper slider stop block when sliding downward, and the second zipper slider on the lower side is collided by the second zipper slider stop block when sliding upward; and the protruding parts of the intermediate sealing ends on the left and right sides collide with each other to form a sealing structure. At this time, the zipper part completes locking and sealing. When unzipping is needed, the first zipper slider and the second zipper slider are simultaneously pulled by left and right hands to move outward, so that the intermediate sealing ends on the left and right sides are separated, and the opening is opened to achieve the effect of unsealing.

According to the present invention, a form of double zipper sliders is adopted to make left and right ends stressed at the same time, so that it is more labor-saving to pull open the zipper; the way of pulling open the zipper bidirectionally facilitates operation, and the opening and closing distances of the zipper sliders are short to facilitate use; and the form of the intermediate sealing structure can ensure the air tightness effect of the waterproof sealing zipper.

In addition, the form of double zipper sliders in the present invention is not limited to a mouth zipper, and can be applied to different styles of waterproof sealing zipper structures.

Figure 1:
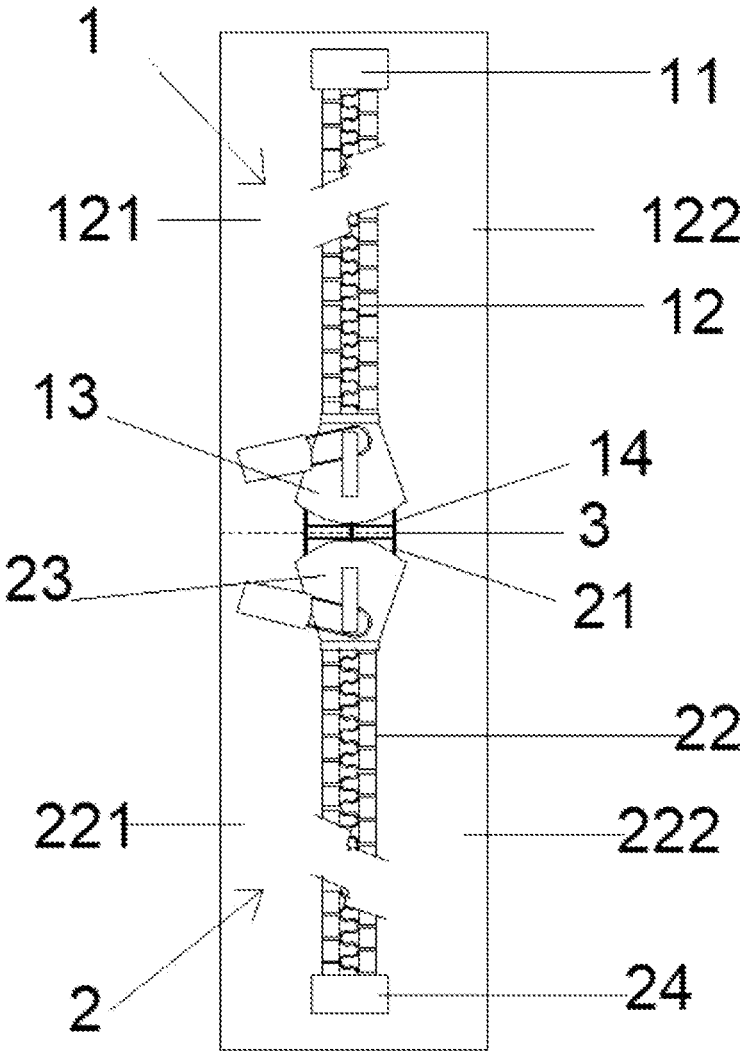
FIG. 1 is a structural diagram when the present invention is sealed.

Description of reference numerals: upper waterproof zipper part 1, first bottom stopper 11, first zipper tooth assembly 12, first left mouth fixing tape 121, first right mouth fixing tape 122, first mouth part 123, first zipper slider 13, first top stopper 14, lower waterproof zipper part 2, second top stopper 21, second zipper tooth assembly 22, second left mouth fixing tape 221, second right mouth fixing tape 222, second mouth part 223, second zipper slider 23, second bottom stopper 24, intermediate sealing structure 3, first slider stop block 31, second slider stop block 32, intermediate sealing end 33, protruding part 34, opening 4, weaving tape layer 5, and TPU waterproof membrane layer 6.

DETAILED DESCRIPTION OF THE EMBODIMENTS

The specific content of the present invention will be described in detail below in conjunction with the accompanying drawings and embodiments.

Figure 2:
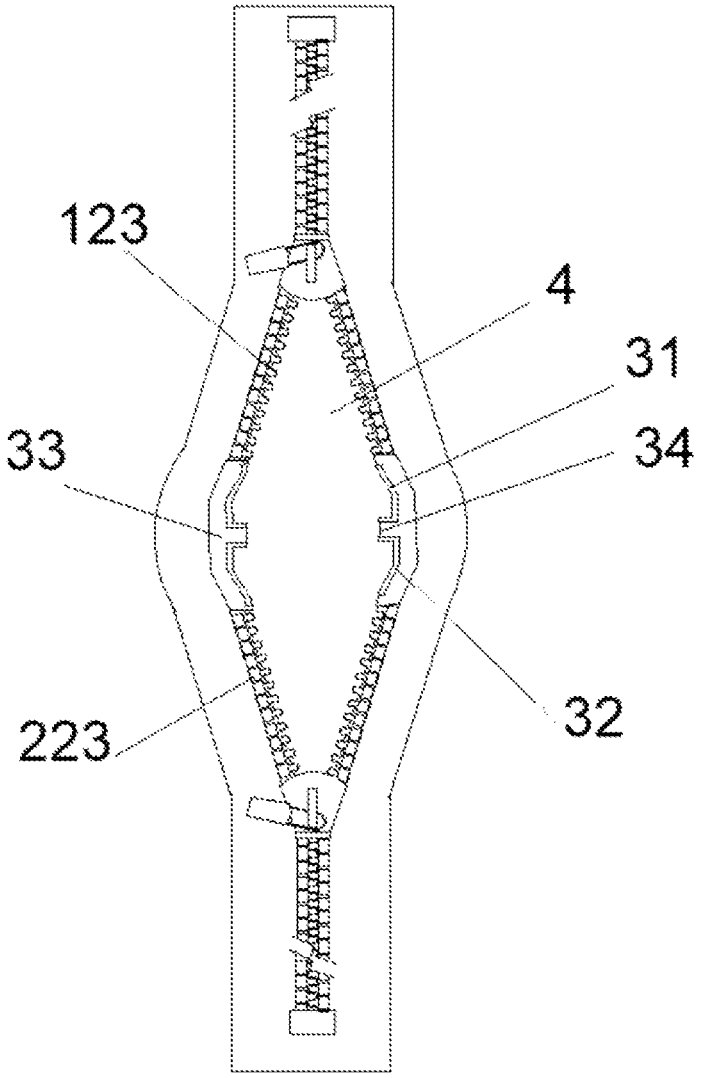
FIG. 2 is a structural diagram when the mouth of the present invention is opened.
Figure 3:
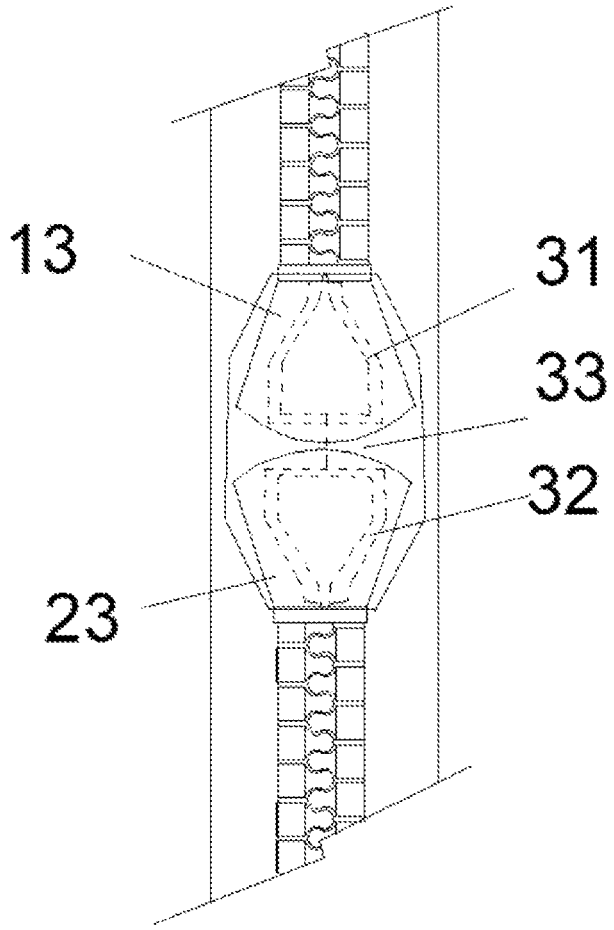
FIG. 3 is a structural schematic diagram of intermediate sealing ends of the present invention.
Figure 4:
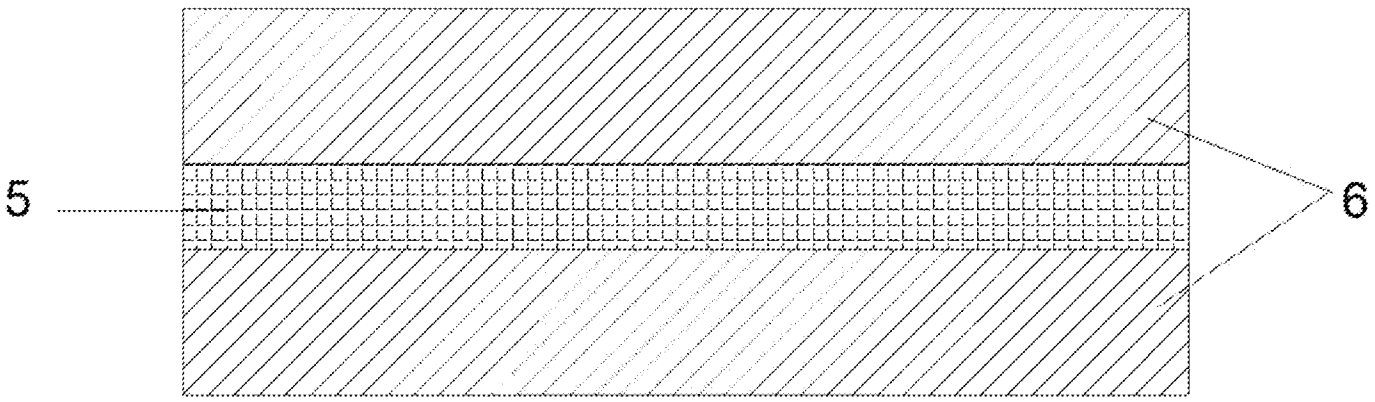
FIG. 4 is a schematic diagram of a hierarchical structure of a mouth fixing tape of the present invention.

Referring to FIGS. 1-4, the present invention provides a waterproof airtight zipper without double zipper sliders, including: an upper waterproof zipper part 1 and a lower waterproof zipper part 2, where the upper waterproof zipper part 1 includes a first bottom stopper 11, a first zipper tooth assembly 12, a first zipper slider 13 and a first top stopper 14; an upper end of the first zipper tooth assembly 12 is provided with the first bottom stopper 11; a lower end of the first zipper tooth assembly 12 is provided with the first top stopper 14; the first slider 13 is mounted between the first bottom stopper 11 and the first top stopper 14; the lower waterproof zipper part 2 includes a second top stopper 21, a second zipper tooth assembly 22, a second zipper slider 23 and a second bottom stopper 24; an upper end of the second zipper tooth assembly 22 is provided with the second top stopper 21; a lower end of the second zipper tooth assembly 22 is provided with the second bottom stopper 24; the second slider 23 is mounted between the second top stopper 21 and the second bottom stopper 24; a lower edge of the first top stopper 14 and an upper edge of the second top stopper 21 are fixedly connected as an integral intermediate sealing structure 3; the intermediate sealing structure 3 is located between both the sliders of the upper waterproof zipper part 1 and the lower waterproof zipper part 2 and is arranged in a disconnected manner; and an opening 4 is formed at the intermediate sealing structure 3 when the first zipper slider 13 and the second zipper slider 23 move upwards and downwards respectively.

Further, in order to achieve the engaged sealing between the first zipper tooth assembly 12 and the second zipper tooth assembly 22, the first zipper tooth assembly 12 includes a first left mouth fixing tape 121, a first right mouth fixing tape 122 and first mouth parts 123; the first mouth parts 123 are respectively mounted at the edges of inside tapes of the first left mouth fixing tape 121 and the first right mouth fixing tape 122; the first mouth parts 123 on the left and right sides are arranged in an interlocking manner; and the first left mouth fixing tape 121 and the first right mouth fixing tape 122 are arranged colliding with each other;

the second zipper tooth assembly 22 includes a second left mouth fixing tape 221, a second right mouth fixing tape 222 and second mouth parts 223; the second mouth parts 223 are respectively mounted at the edges of inside tapes of the second left mouth fixing tape 221 and the second right mouth fixing tape 222; the second mouth parts 223 on left and right sides are arranged in an interlocking manner; and the second left mouth fixing tape 221 and the second right mouth fixing tape 222 are arranged colliding with each other.

Further, in order to ensure better waterproofness and air tightness, the upper and lower zipper parts are aligned with each other, the first left mouth fixing tape 121 and the second left mouth fixing tape 221 are integrally formed, and the first right mouth fixing tape 122 and the second right mouth fixing tape 222 are integrally formed.

Further, in order to obtain a better waterproof sealing effect, each of the first left mouth fixing tape 121, the first right mouth fixing tape 122, the second left mouth fixing tape 221 and the second right mouth fixing tape 222 is composed of a weaving tape layer 5 and a TPU waterproof membrane layer 6; the weaving tape layer 5 is an inner layer; and the TPU waterproof membrane layer 6 is wrapped on upper and lower layers of the weaving tape layer 5.

Further, the intermediate sealing structure 3 includes a first zipper slider stop block 31, a second zipper slider stop block 32 and intermediate sealing ends 33; the intermediate sealing structure 3 is divided into a two-part structure with symmetrical left and right parts; the intermediate sealing structure 3 from top to bottom provides the first zipper slider stop block 31, the intermediate sealing ends 33 and the second slider stop block 32 in sequence; the first zipper slider stop block 31 and the first zipper slider 13 are arranged colliding with each other; the second zipper slider stop block 32 and the second zipper slider 23 are arranged colliding with each other; the intermediate sealing ends 33 on the left and right sides are provided with protruding parts 34 in a protruding manner towards the center; and the protruding parts 34 are arranged colliding with each other when the first zipper slider 13 and the second zipper slider 23 are located at the intermediate sealing structure 3. When the protruding parts 34 of the intermediate sealing ends 33 collide with each other, the zipper is sealed.

In this embodiment, the upper waterproof zipper part 1 and the lower waterproof zipper part 2 are arranged; the bottom stopper of the upper waterproof zipper part 1 and the top stopper of the lower waterproof zipper part 2 are fixedly connected to each other to form the integral intermediate sealing structure 3; the intermediate sealing structure 3 is provided with the first zipper slider stop block 31, the second slider stop block 32 and the intermediate sealing ends 33; the first zipper slider 13 on the upper side is collided by the first zipper slider stop block 31 when sliding downward, and the second zipper slider 23 on the lower side is collided by the second zipper slider stop block 32 when sliding upward; and the protruding parts 34 of the intermediate sealing ends 33 on the left and right sides collide with each other to form the sealing structure. At this time, the zipper part completes locking and sealing. When unzipping is needed, the first zipper slider 13 and the second zipper slider 23 are simultaneously pulled by left and right hands to move outward, so that the intermediate sealing ends 33 on the left and right sides are separated, and the opening 4 is opened to achieve the effect of unsealing.

According to the embodiment, the form of double zipper sliders is adopted to make left and right ends stressed at the same time, so that it is more labor-saving to pull open the zipper; the way of pulling open the zipper bidirectionally facilitates operation, and the opening and closing distances of the zipper sliders are short to facilitate use; and the form of the intermediate sealing structure 3 can ensure the air tightness effect of the waterproof scaling zipper.

Finally, it is to be noted that the above embodiments are only used to illustrate rather than limit the technical solutions of the present invention. Although the present invention has been described in detail with reference to preferred embodiments, those of ordinary skill in the art should understand that modifications or equivalent replacements can be made to the technical solutions of the present invention without departing from the spirit and scope of the technical solutions of the present invention, and should be all covered by the claims of the present invention.

Standard parts used in the present invention can be purchased from the market, and special-shaped parts can be customized according to the description in the specification and the accompanying drawings. Specific connection methods of each part adopt conventional means such as bolts, rivets, and welding that are mature in the prior art; machines, parts and equipment all adopt conventional models in the prior art; and circuit connection adopts conventional connection methods in the prior art, which will not be described in detail herein.

In the description of the present invention, unless otherwise expressly specified and defined, terms "mounted", "connected", "connecting" and "fixed" shall be understood broadly, which, for example, may be a fixed connection, a detachable connection, or integrated; may be a mechanical connection or an electrical connection; and may be directly connected, or connected through an intermediate medium, or may be a communication between two elements or an interaction between two elements. For those skilled in the art, the specific meaning of the above terms in the present invention can be understood in specific circumstances.

What is claimed is:

1. A waterproof airtight zipper with double zipper sliders, comprising:

an upper waterproof zipper part and a lower waterproof zipper part, wherein the upper waterproof zipper part comprises a first bottom stopper, a first zipper tooth assembly, a first zipper slider and a first top stopper; an upper end of the first zipper tooth assembly is provided with the first bottom stopper; a lower end of the first zipper tooth assembly is provided with the first top stopper; the first zipper slider is mounted between the first bottom stopper and the first top stopper;

the lower waterproof zipper part comprises a second top stopper, a second zipper tooth assembly, a second zipper slider and a second bottom stopper; an upper end of the second zipper tooth assembly is provided with the second top stopper; a lower end of the second zipper tooth assembly is provided with the second bottom stopper; the second zipper slider is mounted between the second top stopper and the second bottom stopper;

a lower edge of the first top stopper and an upper edge of the second top stopper are fixedly connected as an integral intermediate sealing structure; the intermediate sealing structure is located between both the zipper sliders of the upper waterproof zipper part and the lower waterproof zipper part and is arranged in a disconnected manner; and an opening is formed at the intermediate sealing structure when the first zipper slider and the second zipper slider move upwards and downwards respectively;

the intermediate sealing structure comprises a first zipper slider stop block, a second zipper slider stop block and intermediate sealing ends; the intermediate sealing structure from top to bottom provides the first zipper slider stop block, the intermediate sealing ends and the second zipper slider stop block in sequence; the first zipper slider stop block and the first zipper slider are arranged colliding with each other; the second zipper slider stop block and the second zipper slider are arranged colliding with each other; the intermediate sealing ends on left and right sides are provided with protruding parts in a protruding manner towards a center; and the protruding parts are arranged colliding with each other when the first zipper slider and the second zipper slider are located at the intermediate sealing structure.

2. The waterproof airtight zipper with double zipper sliders according to claim 1, wherein the first zipper tooth assembly comprises a first left mouth fixing tape, a first right mouth fixing tape and first mouth parts; the first mouth parts are respectively mounted at edges of inside tapes of the first left mouth fixing tape and the first right mouth fixing tape; the first mouth parts on left and right sides are arranged in an interlocking manner; and the first left mouth fixing tape and the first right mouth fixing tape are arranged colliding with each other;

the second zipper tooth assembly comprises a second left mouth fixing tape, a second right mouth fixing tape and second mouth parts; the second mouth parts are respectively mounted at edges of inside tapes of the second left mouth fixing tape and the second right mouth fixing tape; the second mouth parts on left and right sides are arranged in an interlocking manner; and the second left mouth fixing tape and the second right mouth fixing tape are arranged colliding with each other.

3. The waterproof airtight zipper with double zipper sliders according to claim 2, wherein the first left mouth fixing tape and the second left mouth fixing tape are integrally formed, and the first right mouth fixing tape and the second right mouth fixing tape are integrally formed.

4. The waterproof airtight zipper with double zipper sliders according to claim 2, wherein each of the first left mouth fixing tape, the first right mouth fixing tape, the second left mouth fixing tape, and the second right mouth fixing tape is composed of a weaving tape layer and a thermoplastic polyurethane (TPU) waterproof membrane layer; the weaving tape layer is an inner layer; and the TPU waterproof membrane layer is wrapped on upper and lower layers of the weaving tape layer.

* * * * *